United States Patent [19]

Uehara

[11] Patent Number: 4,726,795

[45] Date of Patent: Feb. 23, 1988

[54] NON-VIBRATING STRUCTURE OF AN OUTBOARD MOTOR

[75] Inventor: Hidehiko Uehara, Hamamatsu, Japan

[73] Assignee: Sanshin Kogyo Kabushiki Kaisha, Japan

[21] Appl. No.: 851,936

[22] Filed: Apr. 14, 1986

[30] Foreign Application Priority Data

May 14, 1985 [JP] Japan ..... 60-100565

[51] Int. Cl.[4] ..... B63H 1/15

[52] U.S. Cl. ..... 440/52; 440/76; 440/900

[58] Field of Search ..... 440/52, 76, 77, 78, 440/113, 900, 88

[56] References Cited

U.S. PATENT DOCUMENTS

| | | | |
|---|---|---|---|
| 2,909,031 | 10/1959 | Kiekhaefer | 440/900 X |
| 4,033,282 | 7/1977 | Pichl | 440/78 |

FOREIGN PATENT DOCUMENTS

| | | | |
|---|---|---|---|
| 687869 | 6/1964 | Canada | 440/52 |
| 120597 | 7/1984 | Japan | 440/52 |
| 230896 | 12/1984 | Japan | 440/52 |

*Primary Examiner*—Sherman D. Basinger
*Assistant Examiner*—Paul E. Salmon
*Attorney, Agent, or Firm*—Ernest A. Beutler

[57] ABSTRACT

An improved vibration damping structure for an outboard drive having a drive shaft housing with a pair of spaced apart side walls. A resilient coupling is provided between the spaced side walls for damping vibrations.

10 Claims, 4 Drawing Figures

NON-VIBRATING STRUCTURE OF AN OUTBOARD MOTOR

BACKGROUND OF THE INVENTION

This invention relates to a non-vibrating structure of an outboard motor and more particularly to an improved arrangement for avoiding and reducing vibrations of the drive shaft housing of an outboard drive.

Noise problems associated with marine outboard drives, be they outboard motors or the outboard drive portion of an inboard/outboard arrangement are well known. Normally, these outboard drives include a generally hollow drive shaft housing through which an engine driven drive shaft extends and also through which exhaust gases are discharged. Normally, the arrangement employs a muffling system within the drive shaft housing for silencing the exhaust gases. The drive shaft housing is normally a unitary casting that has a tubular shape with opposing side walls. Because of its relatively light weight construction, the side walls provide resonance elements which can actually amplify the sounds and vibrations generated within the drive shaft housing. Therefore, they can well amplify the noise of the outboard drive unit.

Although devices have been provided to attempt to silence these vibrations, the devices of the type heretofore proposed have been extremely complicated, cumbersome and have added considerably to the cost and weight of the outboard drive.

It is, therefore, a principal object of this invention to provide an improved anti-vibration device for the drive shaft housing of a marine outboard drive.

It is a further object of this invention to provide an improved and simplified arrangement for damping the vibrations of the drive shaft housing of an outboard drive.

SUMMARY OF THE INVENTION

This invention is adapted to be embodied in an outboard drive having a drive shaft housing that is defined by a generally tubular body having a pair of spaced apart walls that define a generally open space between them. A drive shaft extends through and is journaled within the drive shaft housing. In accordance with the invention, resilient means are provided for interconnecting the walls between their ends for damping vibration.

DETAILED DESCRIPTION OF THE PREFERRED EMBODIMENT

Figure 1:
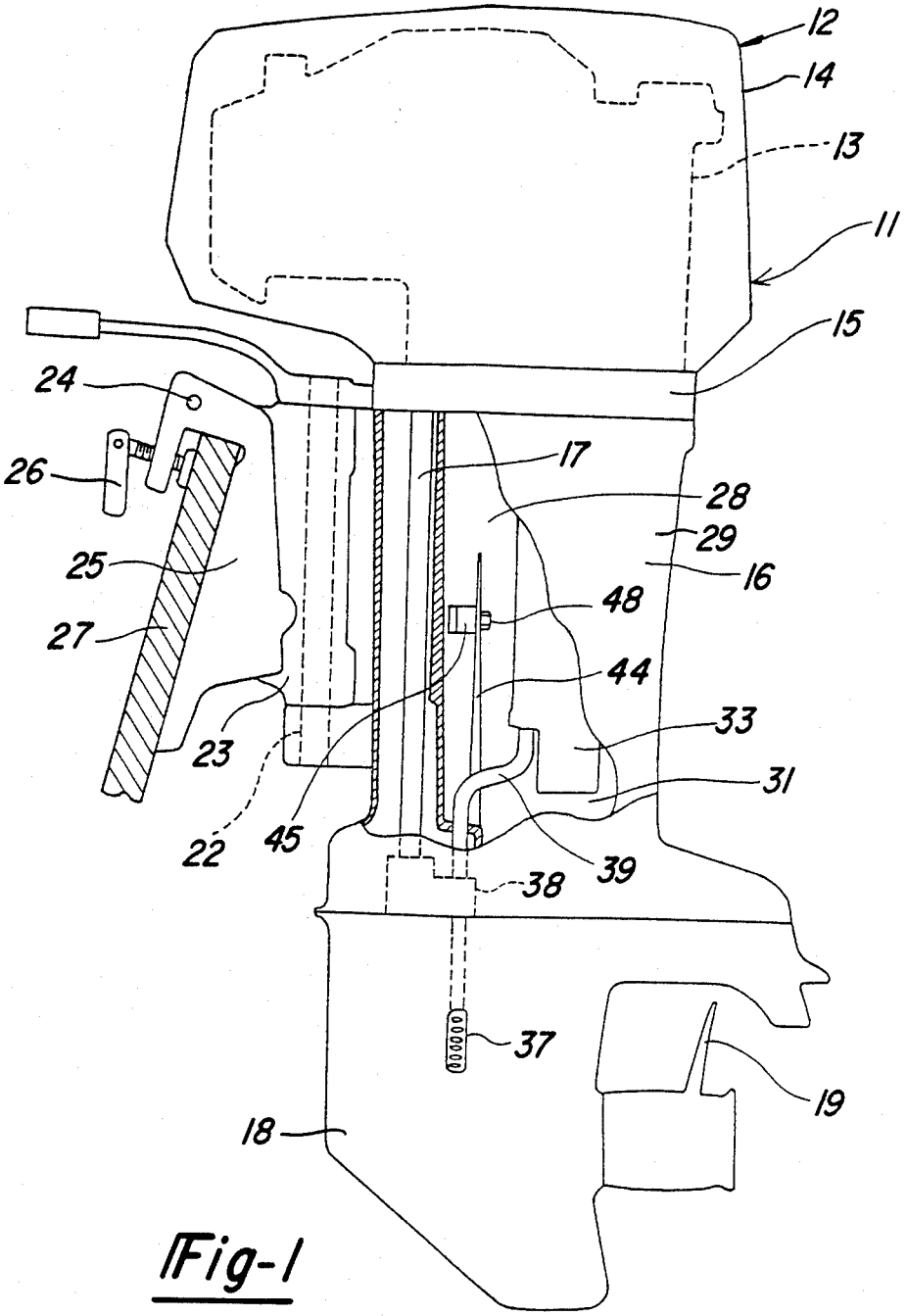
FIG. 1 is a side elevational view of an outboard motor constructed in accordance with an embodiment of this invention, with portions broken away.

Referring first to FIG. 1, an outboard motor constructed in accordance with an embodiment of the invention is identified generally by the reference numeral 11. As has been noted, the invention may be utilized in conjunction with either outboard motors or the outboard drive of an inboard/outboard arrangement. However, the invention has particular utility in connection with outboard motors since they are more prone to vibrations of the type which this invention reduces.

The outboard motor 11 is comprised of a power head, indicated generally by the reference numeral 12, which includes an internal combustion engine 13, of any known type, and a surrounding protective cowling 14. A spacer plate 15 connects the power head 12 to the upper end of a drive shaft housing 16. The drive shaft housing, as will become more apparent, is of a generally tubular configuration and contains and journals a drive shaft 17 that is driven by the engine 13.

A lower unit 18 depends from the drive shaft housing 16 and contains a forward, neutral, reverse transmission (not shown) for driving a propeller 19 from the drive shaft 17.

The drive shaft housing 16 has affixed to it a steering shaft 22 which is journaled for rotation within a swivel bracket 23 for steering of the outboard motor 11 about a generally vertically extending steering axis. The swivel bracket 23 is, in turn, pivotally connected by a pivot pin 24 to a clamping bracket 25. The pivot pin 24 permits tilting movement of the outboard motor 11 about the axis of the pivot pin 24. A clamping arrangement 26 is carried by the clamping bracket 25 for attachment to a transom 27 of an associated watercraft.

Referring now additionally to the remaining figures, the drive shaft housing 16, as has been noted, is of a generally tubular shape and has a front and rear wall that are integrally connected by spaced apart side walls 28 and 29. Normally the drive shaft housing 16 is formed as a single piece, light metal casting and, in addition to the drive shaft 17, there is provided an internal expansion chamber 31 for silencing the exhaust gases of the engine 13.

The exhaust gases are delivered to the expansion chamber 31 from the exhaust outlet of the engine 13 through an exhaust passage 32 formed in the spacer plate 15 and an exhaust pipe 33 that depends into the expansion chamber 31 and which is fixed to the spacer plate 15 by means of a plurality of threaded fasteners 34. The exhaust gases from the expansion chamber 31 are discharged through an underwater exhaust gas discharge of any known type when the associated watercraft is traveling at high speeds. At low speeds, the exhaust gases are delivered from the expansion chamber 31 to a further expansion chamber 35 through a restricted orifice (not shown) for discharge to the atmosphere through an above the water exhaust gas discharge 36. The expansion chamber 35 communicates with the above the water exhaust gas discharge 36 through a restricted orifice (not shown). Since the exhaust system per se forms no part of the invention, it has not been illustrated in any further detail since those skilled in the art should readily understand that this invention may be employed with a wide variety of exhaust systems normally associated with outboard motors and outboard drives.

The engine 13 is also provided with a cooling system that includes an underwater cooling inlet 37 that is formed in the lower unit 18. Water is drawn into this inlet 37 by means of a water pump 38 that is driven from the drive shaft 17 and which is positioned at the interface between the drive shaft housing 16 and the lower unit 18. The water pump 38 discharges coolant under pressure through a conduit 39 into a water delivery chamber 41 that is formed integrally with the exhaust pipe 33 and thus serves to provide some cooling for the exhaust pipe 33. From the water delivery chamber 41, the water passes upwardly through a passage 42 in the spacer plate 15 and enters the cooling jacket of the engine 13 in an appropriate manner. The water is then discharged after it has circulated through this cooling jacket through a water discharge passage 43 that is formed in the spacer plate 15 for eventual discharge back into the body of water through the drive shaft housing 16 in any known manner.

The construction of the outboard motor 11 and the internal components of the drive shaft housing 16 as thus far described are generally conventional.

It should be readily apparent that the hollow configuration of the drive shaft housing 13 and the spacing and length of the opposing side walls 28 and 29 is such that vibrations can well be set up in these walls 28 and 29 due to the noise of the exhaust gases, vibrations from the engine 13, vibrations caused by the propeller 19 and a wide variety of other vibration sources. The side walls 28 and 29 could, therefore, act as sounding boards to actually amplify the noises thus generated.

Figure 3:
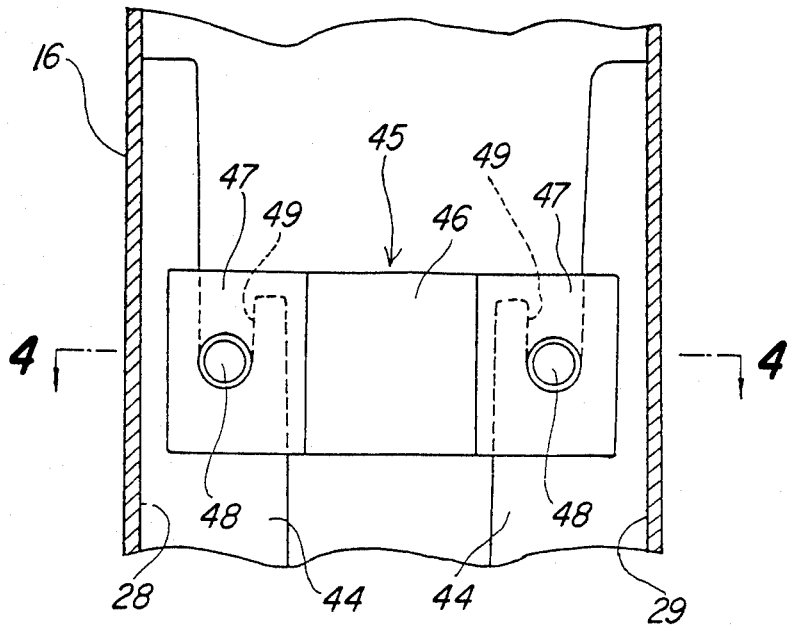
FIG. 3 is a cross-sectional view taken along the line 3—3 of FIG. 2.
Figure 4:
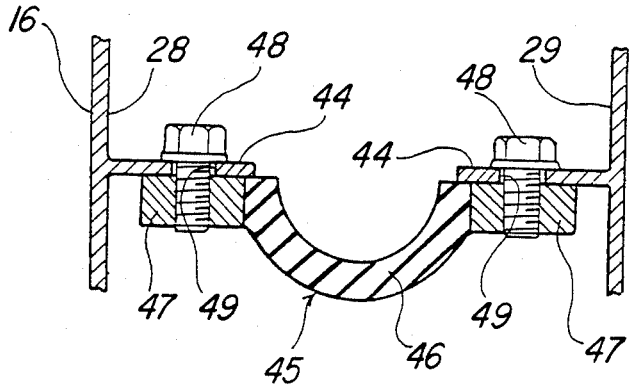
FIG. 4 is a cross-sectional view taken along the line 4—4 of FIG. 3.

In accordance with the invention, an arrangement is provided for resiliently interconnecting the side walls 28 and 29 between their forward and rearward ends and at their upper and lower mid points so as to dampen such vibrations. This mechanism is shown in most detail in FIGS. 3 and 4.

It will be seen that the side walls 28 and 29 have respective inwardly extending integral flanges 44 that are spaced apart at their inner peripheries. Affixed to these flanges is an elastic coupling member and damper, indicated generally by the reference numeral 45. Although the damper 45 may take any particularly shape, it is comprised, in the illustrated embodiment, of a generally cylindrical segmented elastomer member 46 that is affixed at its opposite ends, as by bonding or vulcanizing, to mounting plates 47. The mounting plates 47 are each formed with tapped openings for attachment to the flanges 44 by means of bolts 48. The bolts 48 pass through upwardly opening slots 49 formed in the upper ends of the flanges 44. As a result, this connection between the side walls 28 and 29 has been found to be very effective in damping vibrations of the side wall and reducing noise.

Figure 2:
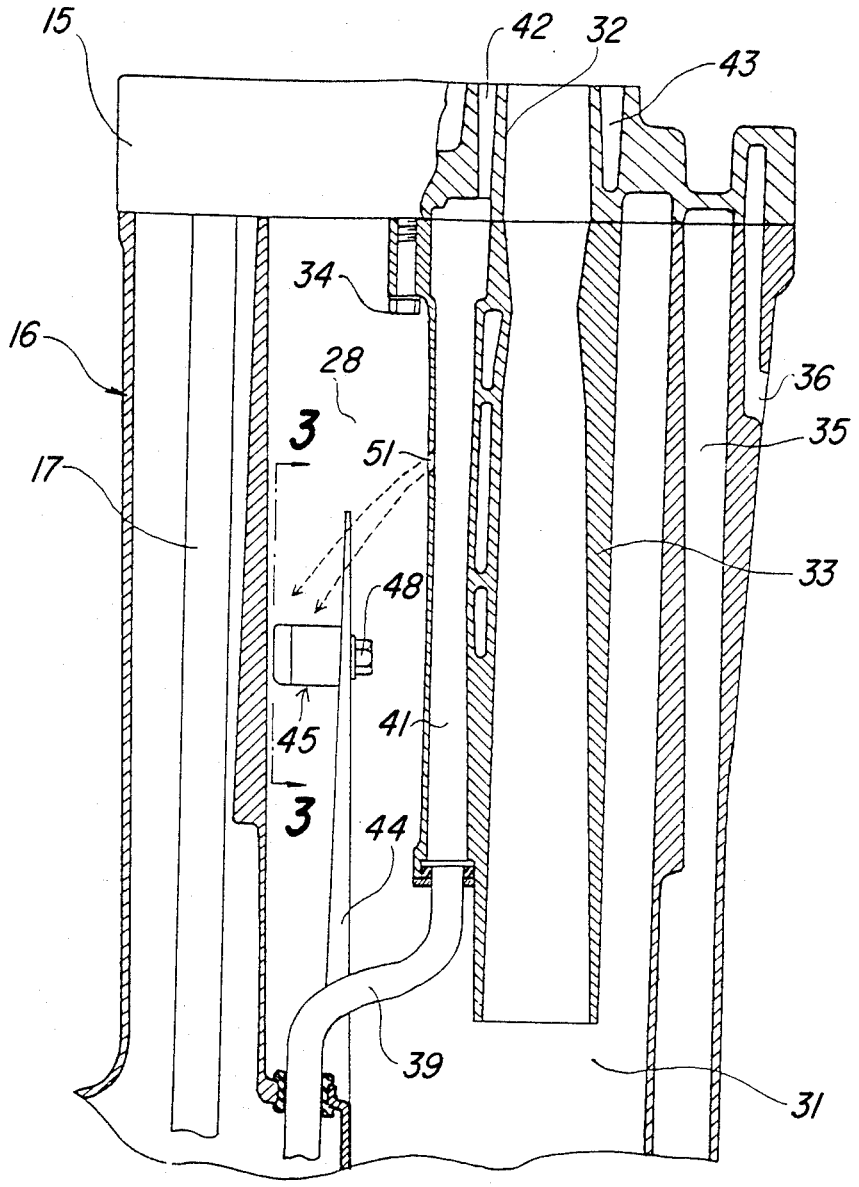
FIG. 2 is an enlarged cross-sectional view taken through the drive shaft housing of the outboard motor.

Because of the proximity to the exhaust pipe and in order to prevent overheating and damage of the damping member 45, the coolant delivery channel 41 of the exhaust pipe 33 is provided with a water discharge opening 51 that is disposed so that it will spray cooling water onto the damping member 45 as shown by the dotted lines in FIG. 2. Thus, it will be insured that the damping member 45 has a long service life and will not deteriorate with age or usage.

It should be readily apparent from the foregoing description that a readily simple, high effective and low cost arrangement has been disclosed for damping vibrations emanating from the drive shaft housing of an outboard drive. Although an embodiment of the invention has been illustrated and described, various changes and modifications may be made without departing from the spirit and scope of the invention, as defined by the appended claims.

I claim:

1. In an outboard drive having a drive shaft housing defined by a generally tubular body having a pair of spaced apart vertically extending side walls having upper and lower ends defining a generally open space therebetween, a power head including an internal combustion engine affixed to the upper end of said drive shaft housing, a lower unit fixed to the lower end of said drive shaft housing and a drive shaft extending through said drive shaft housing and rotating therein for transferring drive from said engine to said lower unit, the improvement comprising resilient means located between the upper and lower ends of said walls interconnecting said walls between their upper and lower ends by interconnecting a pair of inwardly facing side wall flanges that are spaced apart at their inner peripheries and spaced downwardly from said engine and upwardly from said lower unit, for damping vibration thereof.

2. In an outboard drive as set forth in claim 1 wherein the drive shaft housing is formed as a unitary casting.

3. In an outboard drive as set forth in claim 1 further including an exhaust gas expansion chamber contained within the drive shaft housing and including means for delivering exhaust gases thereto.

4. In an outboard drive as set forth in claim 3 further including means for delivering a coolant through the drive shaft housing for the engine which drives the drive shaft.

5. In an outboard drive as set forth in claim 4 wherein the means for delivering coolant includes a discharge opening for discharging water onto the resilient means.

6. In an outboard drive as set forth in claim 1 wherein the pair of inwardly facing flanges are formed integrally with the spaced apart walls.

7. In an outboard drive as set forth in claim 6 wherein the resilient means includes an elastomer element.

8. In an outboard drive as set forth in claim 7 further including an exhaust gas expansion chamber contained within the drive shaft housing and including means for delivering exhaust gases thereto.

9. In an outboard drive as set forth in claim 8 further including means for delivering a coolant through the drive shaft housing for the engine which drives the drive shaft.

10. In an outboard drive as set forth in claim 9 wherein the means for delivering coolant includes a discharge opening for discharging water onto the resilient means.

* * * * *